US011192684B2

(12) United States Patent
Gabrys et al.

(10) Patent No.: US 11,192,684 B2
(45) Date of Patent: Dec. 7, 2021

(54) CORRUGATED PALLET WITH IMPROVED TOP-TO-BOTTOM LOCKING

(71) Applicants: Christopher W. Gabrys, Reno, NV (US); E. Neil Schopke, Rockledge, FL (US); Joseph J. Danko, Key Largo, FL (US)

(72) Inventors: Christopher W. Gabrys, Reno, NV (US); E. Neil Schopke, Rockledge, FL (US); Joseph J. Danko, Key Largo, FL (US)

( * ) Notice: Subject to any disclaimer, the term of this patent is extended or adjusted under 35 U.S.C. 154(b) by 0 days.

(21) Appl. No.: 16/934,927

(22) Filed: Jul. 21, 2020

(65) Prior Publication Data

US 2021/0261294 A1 Aug. 26, 2021

Related U.S. Application Data

(60) Provisional application No. 62/980,179, filed on Feb. 22, 2020, provisional application No. 63/013,657, filed on Apr. 22, 2020.

(51) Int. Cl.
*B65D 19/00* (2006.01)

(52) U.S. Cl.
CPC ..... *B65D 19/0036* (2013.01); *B65D 2519/00019* (2013.01); *B65D 2519/00054* (2013.01); *B65D 2519/00273* (2013.01); *B65D 2519/00278* (2013.01); *B65D 2519/00567* (2013.01)

(58) Field of Classification Search
CPC ..... B65D 19/00; B65D 2519/00019; B65D 2519/00054; B65D 2519/00089; B65D 2519/00273; B65D 2519/00278
USPC ..... 108/51.3
See application file for complete search history.

(56) References Cited

U.S. PATENT DOCUMENTS 2,611,569 A * 9/1952 Coleman ..... B65D 19/0026 108/51.3
2,908,464 A 10/1959 Traudt
2,925,978 A * 2/1960 Marso ..... B65D 19/20 108/51.3

(Continued)

FOREIGN PATENT DOCUMENTS

EP 598540 A1 * 5/1994
WO WO 2015/121700 8/2015

(Continued)

*Primary Examiner* — Jose V Chen
(74) *Attorney, Agent, or Firm* — J. Michael Neary

(57) ABSTRACT

A corrugated pallet folded together from two planar blanks, including a pallet top that supports a load above a floor, and a pallet bottom that rests on the floor. Each pallet top and pallet bottom has multiple double thickness interior support ribs folded vertically from the plane of the pallet top and bottom. Ribs from the pallet top intersect with ribs from the pallet bottom perpendicularly and support the pallet top on the pallet bottom. Multiple mechanical vertical locks hold the pallet top in vertically spaced relation with the pallet bottom with middle straps folded vertically from the pallet top and/or pallet bottom into contact with interior surfaces of the pallet and lock directly into sides of the interior support ribs at positions intermediate the pallet top and bottom. Reinforcement tubes are provided over intersections of double thickness ribs at the corners of the pallet while folded doubled thickness ribs provide compression support near the center.

20 Claims, 15 Drawing Sheets

(56) References Cited

U.S. PATENT DOCUMENTS

| | | | | | |
|---|---|---|---|---|---|
| 3,601,067 | A * | 8/1971 | Olsen | B65D 19/0097 108/51.3 |
| 3,683,823 | A | 8/1972 | Schmid | |
| 4,228,744 | A | 10/1980 | Moore | |
| 4,429,486 | A | 2/1984 | Bjornstad | |
| 4,487,136 | A * | 12/1984 | Beckway | B65D 19/0028 108/51.3 |
| 4,875,419 | A | 10/1989 | Helton | |
| 4,966,084 | A * | 10/1990 | Motomaru | B65D 19/0012 108/51.3 |
| 5,452,667 | A | 9/1995 | Lim | |
| 5,520,120 | A | 5/1996 | Badger | |
| 5,528,995 | A * | 6/1996 | Lim | B65D 19/0012 108/56.1 |
| 6,029,582 | A | 2/2000 | Ogilvie, Jr. | |
| 7,007,613 | B2 * | 3/2006 | Sketo | B65D 19/0012 108/51.3 |
| 7,234,402 | B2 | 6/2007 | Olvey | |
| 7,426,890 | B2 | 9/2008 | Olvey | |
| 7,980,184 | B2 | 7/2011 | Olvey | |
| 8,479,666 | B2 | 7/2013 | Olvey | |
| 9,796,503 | B2 * | 10/2017 | Gabrys | B65D 19/44 |
| 10,246,219 | B2 * | 4/2019 | Herbeck | B65D 19/0016 |
| 10,392,159 | B2 | 8/2019 | Olvey | |
| 2006/0102055 | A1 * | 5/2006 | Wu | B65D 19/0028 108/51.3 |
| 2011/0245059 | A1 | 10/2011 | Olvey | |
| 2013/0186309 | A1 * | 7/2013 | Niu | B65D 19/0012 108/51.3 |
| 2016/0304240 | A1 * | 10/2016 | Olvey | B65D 19/0014 |
| 2019/0177036 | A1 * | 6/2019 | Dominguez Guevara | B65D 19/0071 |

FOREIGN PATENT DOCUMENTS

| | | | |
|---|---|---|---|
| WO | WO2018/164760 | * | 9/2018 |
| WO | WO 2019/068063 | | 4/2019 |

* cited by examiner

CORRUGATED PALLET WITH IMPROVED TOP-TO-BOTTOM LOCKING

This invention pertains to pallets for shipping goods, and more particularly to a corrugated pallet comprising two pieces of corrugated paperboard that are assembled by folding together with multiple integral folded support ribs, and held vertically assembled with a unique mechanical lock method that provides high strength, while both increasing the pallet mechanical performance and speeding its assembly. A hybrid support system of cores at corners for stability and impact resistance is combined with wider and lower cost integral folded double thickness ribs for better load support. No adhesives, adhesive mess or adhesive cure time are required. The pallet can also be rapidly and easily disassembled for recycling.

BACKGROUND OF THE INVENTION

Pallets are said to move the world. Eighty percent of commerce ships on pallets. The pallet industry is estimated at greater than $30 B worldwide. More than 500 million pallets are manufactured in the US each year, with 1.8 billion pallets in service in the US alone.

Pallets can be made from various materials; however wood pallets currently comprise about 80% of the market. More than 40% of worldwide hardwood lumber currently goes toward the manufacturing of wood pallets. Other materials used for pallet manufacturing include plastic, metal and corrugated paperboard. Wood pallets are reusable unless they are damaged in transit, which is not uncommon. Damaged wood pallets are generally not recycled and are disposed of by burning, causing environmental damage by carbon emissions. Moreover, wood pallets are heavy, increasing the weight of airborne shipment, hence waste of energy resources.

Recent regulations regarding infestation and contamination are creating a surge in interest and use of non-wood pallet alternatives. A small, but fast growing segment is the use of corrugated paperboard pallets. Many desire to replace conventional wooden pallets with corrugated pallets for reducing costs, increasing ability to recycle, lowering pallet weight, eliminating product contamination, reducing pallet storage volume and reducing pallet related injuries.

Many different designs of corrugated paperboard pallets have been developed to date. Despite the potential advantages of corrugated pallets, many have suffered from several different deficiencies. These deficiencies include low strength and stiffness, high use of corrugated paperboard, resulting in high material costs, along with high overhead, assembly labor and freight costs. The inherent inability to readily produce and distribute corrugated pallets in sufficiently high volume has also been of critical importance.

Many corrugated pallets were designed to carry intended freight loads successfully, but fail when encountering rough treatment during handling in freight terminals and warehouses. Fork lift operators use techniques for shifting pallet loads that the greater strength of wood pallets can tolerate, such as hurried misaligned entry of the forks into the fork channels of the pallet, and shifting pallet loads sideways without lifting the pallet clear of the floor. Many prospective trials of corrugated pallets have failed because the corrugated pallet under consideration tore or was otherwise damaged by such rough handling. Expecting forklift operators to treat a corrugated pallet gently is a pipedream.

In applications that may encounter roller conveyors somewhere in the pallet shipping and distribution, it is desirable to use a pallet that has a bottom deck, so that can readily roll and be moved freely. One type of such pallets that allows minimized use of corrugated board for lower construction costs are corrugated pallets with integrally-folded vertical supports and top and bottom blanks. The vertically folded supports are integrally folded from the blanks also comprising the horizontal deck panels. The top and bottom blanks with integral vertical supports cooperate to support a shipping load above ground. One of several key problems with these types of pallets has been maintaining the pallet top and pallet bottom held vertically together. One possible method has been the application of adhesive to the rib tops of each blank to bond with the deck of the opposing blank. However, this results in a very small bond area on the rib tops, which allows the pallet to be easily ripped apart, not to mention the difficulty, cost and mess of adhesive application. Another possible method has been to incorporate sidewalls into the pallets and use them for locking the pallet top vertically together with the pallet bottom. This can be accomplished through tuck flaps locking into the opposing blank ribs, but this method is not desirable because the tuck flaps are easily undone during normal fork equipment handling. Another method is to use strap locks extending from side walls to lock over the pallet top and/or bottom. This method is also not desirable because the locks can be damaged and ripped off from pallet sliding as well as impeding product placement when located on the top. Strap locks may alternatively be extended off sidewalls to wrap around the sides of the pallet. However, this configuration is also not desirable because it does not prevent separation of the pallet top and bottom near the center of the pallet edges while also being very wasteful of corrugated board use. Another method is the use of tab locks from the pallet top and bottom that penetrate tuck flaps of the opposing blank. This can resist the tuck flaps of the sidewalls from opening along the whole pallet edges, however it is not desirable because it is not effective in preventing vertical separation of the pallet top from pallet bottom. In general, pallets with sidewalls are harder to enter and exit with fork handling equipment and are easily damaged or destroyed.

What is needed is a new folded support corrugated pallet that does not require sidewalls and provides strong, durable load support, reliable locking of the pallet top to the pallet bottom with minimized costs and easy assembly. The pallet should be invulnerable to damage for pallet handling during shipping. A new corrugated pallet having a bottom deck and top deck, but without required sidewalls, and without requiring the use of adhesives is desired. A new strong corrugated pallet with reliable and easily assembled construction is needed. Development of such a pallet could make a substantial impact on expanding the use of corrugated pallets worldwide.

SUMMARY OF THE INVENTION

The invention provides a corrugated pallet folded together from two opposing blanks comprising a pallet top that supports a load above a floor and a pallet bottom that rests on the floor. Each of the pallet top and the pallet bottom include multiple horizontal deck panels defined by rib base fold lines at base ends of multiple integral double thickness ribs folded from the blanks and extending vertically to distal rib crests at center rib crest fold lines. The ribs from the pallet top intersect with ribs of the pallet bottom perpendicularly and support the pallet top on the pallet bottom resisting vertical compression. The pallet further includes mechanical straps that resist vertical tensile separation of the pallet top with the pallet bottom to lock the pallet together. The straps are folded vertically from the horizontal deck panels and lock to the integral vertically folded double thickness ribs of the opposing blank at positions vertically intermediate between horizontal deck panels of the pallet top and the pallet bottom. The straps from the horizontal deck panels fold perpendicularly to the rib crest fold lines of the integral vertically folded double thickness ribs of the same blank and parallel to the crest fold lines of the integral vertically folded double thickness ribs of the opposing blank.

The pallet allows open sides for unobstructed access to the fork channels, thereby avoiding the need for extra corrugated board for easily damaged sidewalls for locking the pallet top to the pallet bottom. The pallet uses strong and reliable mechanical strap locks, without the need for any extra cardboard, to hold the pallet top and pallet bottom together without required use of adhesive that can easily fail from impact and peel starting from an edge. It uses openings, directly in folded double thickness support ribs located on the interior of the pallet making for an especially strong construction and a pallet that is also easy to enter and exit with pallet lifting equipment without sustaining damage. The locks are uniquely capable of rapid and easy installation. The locking straps are located inside the perimeter of the pallet, not on outer sidewalls, and are hence on an interior surface location in the pallet. The interior straps may also be located yet further inside the pallet, inside the outer set of folded ribs, and are in the middle of the pallet, hence denoted as middle straps.

This construction does have the deficiency of utilizing a high number, eight, of locks to be engaged to lock the pallet top with the pallet bottom. Surprisingly however, we have found that the construction of the pallet in accordance with the invention can enable the locks to be easily engaged, and it allows the pallet to be rapidly assembled.

The locks fold vertically from the horizontal deck panels to provide a strong tensile strength connection between horizontal deck panels and opposing blank vertical double thickness support ribs. We have found that this connection is maintained to be tightest when the straps are kept as vertically oriented as possible for minimized slack. In a further embodiment, the straps of the horizontal deck panels fold vertically to lie adjacent to the integral vertically folded double thickness ribs of the opposing blank.

Straps from the pallet bottom horizontal panels fold upward while straps from the pallet top horizontal panels fold downward. A very efficient orientation to allow locking from both the bottom and top to occur is accomplished in a small area of the pallet by rotationally offsetting the locks. In other embodiments, the straps of the pallet top and the pallet bottom are folded in perpendicular directions to each other. Both sets are able to lock into the opposing blank ribs without conflict, particularly when located together near the pallet corners.

The locking straps may also serve additional functions besides resisting vertical tensile separation of the pallet. In yet a further embodiment, the straps fold vertically from one blank and lock through the integral vertically folded double thickness ribs of the opposing blank whereby heads of the straps resist unfolding of the integral vertically folded double thickness ribs of the opposing blank. This construction does require large recess openings in the support ribs for penetration of locking straps which undesirably tend to reduce the compressive support strength. However, we have found that the benefits of the integrated locked construction overcome the deficiency of reduced compressive strength in actual pallet use. In general, market experience has shown that resistance to handling abuse is substantially more important than total maximum compressive load capacity.

In shipping applications that encounter exceptionally high abuse and large number of fork handling, the pallets in accordance with the invention can be made even more durable and fork impact damage resistance. One such type of shipping is encountered through common less-than-truck-load (LTL) shipping. In another embodiment, the pallet comprises reinforcement tubes surrounding intersections of the integral vertically folded double thickness ribs of the pallet top and the pallet bottom wherein a single reinforcement tube distributes vertical compression against more than two horizontal deck panels. The reinforcement tubes typically comprise paper core tubes which are solid paper and can tolerate significant fork impacts without damage to the pallet.

The use of paper cores may preferably be installed at the same locations of pallet top to bottom locking. In additional embodiments, straps are folded from the horizontal deck panels and lock with the opposing blank by folding through the integral vertically folded double thickness ribs of the opposing blank at locations inside the reinforcement tubes. Although this makes placement of the locks more difficult because of the reduced area for folding and locking, it makes the pallet yet even more robust as the locking is protected from potentially being disengaged through the outer reinforcement tube.

Reinforcement tubes could be placed over every intersection of top and bottom blank ribs. However, we have found that this construction is not typically preferable. It increases the pallet costs for a high number of paper core tubes. Because paper core tube size is generally diameter-limited, it can result in large unsupported top deck spans. This is particularly undesirable when the product load is smaller boxes that may sag down between pallet vertical supports. We have found that the idea design in many cases is surprisingly achieved by use of a combination of vertical supports. In further embodiments, reinforcement tubes provide compression support at locations near the corners of the pallet, and vertically folded double thickness ribs free of reinforcement tubes provide compression support at other locations of the pallet. Utilizing the paper cores in the corners provides maximum benefit to durability against fork handling abuse. In addition, paper cores located at the pallet corners dramatically increases the pallet stability, as paper cores have many times greater vertical compression stiffness than vertically folded corrugated support ribs. This is especially important when multiple loaded pallets are stacked, so that the whole stack of loaded pallets does not sway and is vertically stable. In areas other than the corners of the pallet, we have found that the maximum benefit does not require localized vertical compression stiffness. However, maximum benefits are achieved by providing the widest top deck support with minimized unsupported spans. To accomplish this, longer folded double thickness ribs free of reinforcement that would limit size are preferred. This unique hybrid support system cooperates to provide a very durable, stable pallet with optimum product load support.

In further embodiments, the invention provides corrugated pallet folded together from two opposing blanks comprising top and bottom blanks forming a pallet top blank that supports a load above a floor and a pallet bottom that rests on the floor. Each of the pallet top and the pallet bottom comprise multiple horizontal deck panels, including two outermost horizontal deck panels defined by rib base fold lines and outer deck edges, and at least one inner horizontal deck panel defined by two spaced apart rib base fold lines. The pallet top and bottom also each include multiple integral vertically folded double thickness ribs extending vertically from the rib base fold line to at least one center rib crest fold line. The ribs from the pallet top intersect with ribs of the pallet bottom perpendicularly and support the pallet top on the pallet bottom resisting vertical compression. The pallet further comprises mechanical straps that hold the pallet top in vertically spaced relation with the pallet bottom. The straps are folded vertically from the horizontal deck panels and lock with the integral vertically folded double thickness ribs of the opposing blank at positions intermediate between the pallet top surface and the pallet bottom surface. The straps are folded from the outermost horizontal deck panels and the straps hold the outermost horizontal deck panels to resist deviation from horizontal. By this means, the pallet top and bottom surfaces all the way to the pallet edges are maintained integral with the pallet body, and the pallet resists vertical tensile separation of the pallet top from the pallet bottom. Moreover, the pallet also maintains the top and bottom surfaces to be flat, for both loading product on top and when moving while lifted to prevent damage to the bottom.

DESCRIPTION OF THE PREFERRED EMBODIMENT

Figure 1:
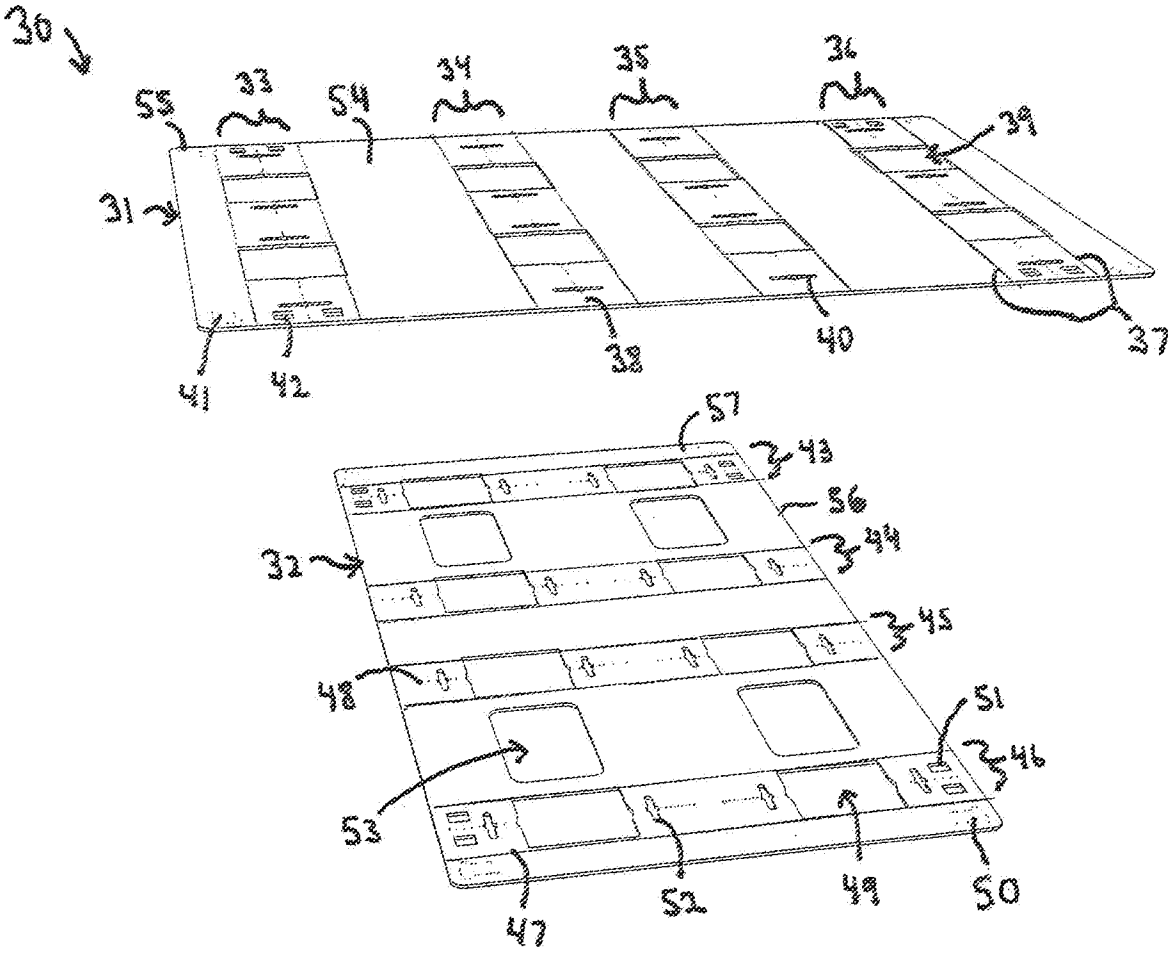
FIG. 1 is an isometric drawing of a corrugated pallet in unassembled state showing planar pallet top and bottom blanks flat in accordance with the invention.
Figure 2:
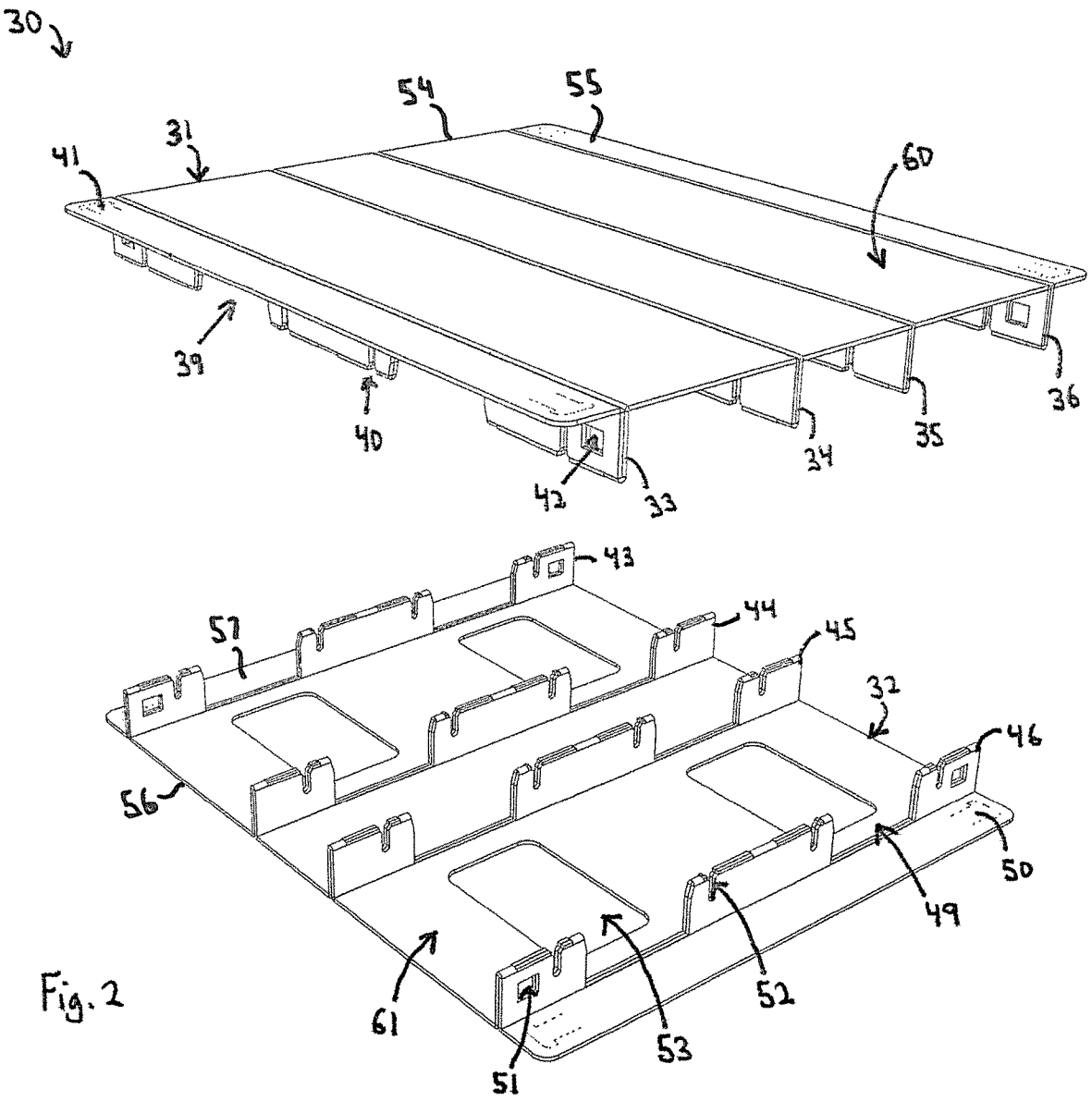
FIG. 2 is an isometric drawing of the corrugated pallet of FIG. 1 with ribs folded in accordance with the invention.
Figure 3:
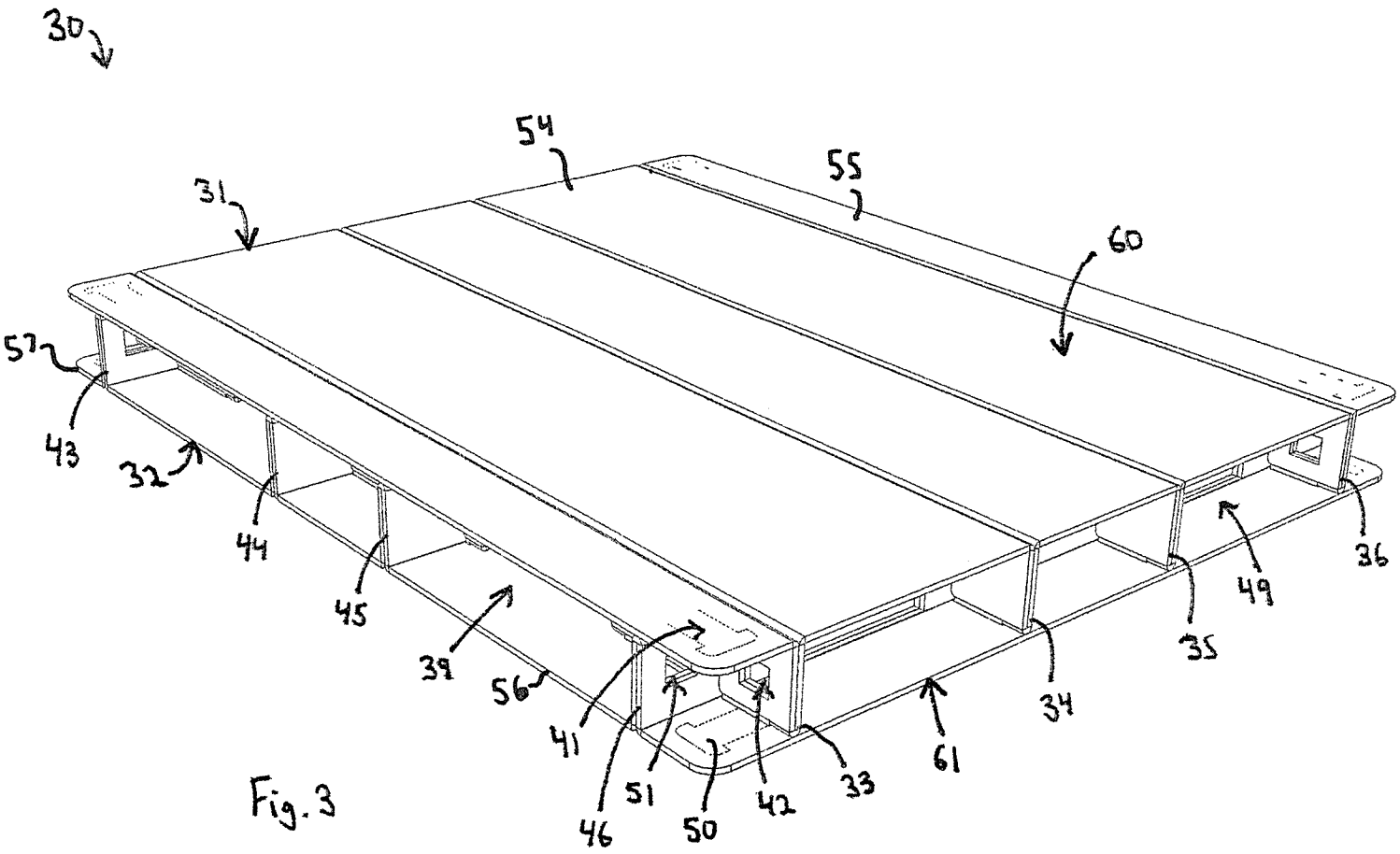
FIG. 3 is an isometric drawing of the corrugated pallet of FIG. 1 with top and bottom blanks nested in accordance with the invention.

Turning to the drawings, wherein like reference characters designate identical or corresponding parts, FIG. 1 shows an isometric drawing of a corrugated pallet in accordance with the invention in unassembled state showing pallet top and bottom blanks flat. The pallet 30 has a planar top blank 31 and bottom blank 32 cut from a sheet of corrugated paperboard or some other suitable material, preferably inexpensive, stiff, durable and recyclable. The top blank comprises rib sections 33, 34, 35, 36 that fold at central crest fold lines 38 and base fold lines 37 to fold double thickness discontinuous ribs, defining horizontal deck panels 54, 55. Cut outs 39 form fork passages 49 as shown in FIGS. 2 and 3. The rib sections 33, 34, 35, 36 also include center notches 40 for mating with center notches 52 in the bottom blank 32 ribs 43-46 after they are formed, as shown in FIGS. 2 and 3. The top blank further comprises interior strap locks 41 and receptacles 42. The bottom blank 32 comprises rib sections 43, 44, 45, 46 with crest fold lines 48 and base fold lines 47 defining horizontal deck panels 56, 57. Rib sections 43, 44, 45, 46 also include notches 52 for mating with the notches 40 in the top blank 31. Cut outs 49 provide fork passages, and pallet jack wheel holes 53 are provided for lifting and moving the assembled and loaded pallet. Interior strap locks 50 and receptacles 51 are provided in the bottom blank 32 to lock with receptacles 42 and interior strap locks 41, respectively, in the top blank 31.

An isometric drawing of the corrugated pallet of FIG. 1 with ribs folded in accordance with the invention is shown in FIG. 2. The pallet 30 is comprised of the pallet top 31 with double thickness discontinuous ribs 33, 34, 35, 36 folded down from the top deck 60 comprised of horizontal deck panels 54, 55. Notches 40 are used for mating with notches 52 in the bottom deck ribs 43, 44, 45, 46, and fork passages 39 allow for lifting with forked handling equipment. Interior strap locks 41 and receptacles 42 are provided for locking the pallet top 31 to the pallet bottom 32. The pallet bottom 32 is comprised of double thickness ribs 43, 44, 45, 46 folded up from the bottom deck 61, comprised of horizontal deck panels 56, 57. The pallet bottom 32 also comprises pallet jack wheel holes for lifting and moving the pallet with a pallet jack, and notches 52 for mating with the pallet top 31 ribs via the notches 40. Interior strap locks 50 and receptacles 51 are provided for locking with the receptacles 42 and strap locks 41, respectively, of the pallet top 31.

An isometric drawing of the corrugated pallet of FIG. 1 in accordance with the invention, with top and bottom blanks nested, but not yet locked, is shown in FIG. 3. The pallet top 31 and pallet bottom 32 are brought vertically together such that notches 40 and 52 mate perpendicularly. Ribs 33, 34, 35, 36 rest on the bottom deck 61 comprised of horizontal deck panels 56, 57, and the top deck 60 comprised of horizontal deck panels 54, 55 rests on ribs 43, 44, 45, 46. Fork passages 39 and 49 allow four way fork entry. Interior strap locks 50 and receptacles 42 will later be used to secure the pallet top 31 and pallet bottom 32 together.

Figure 4:
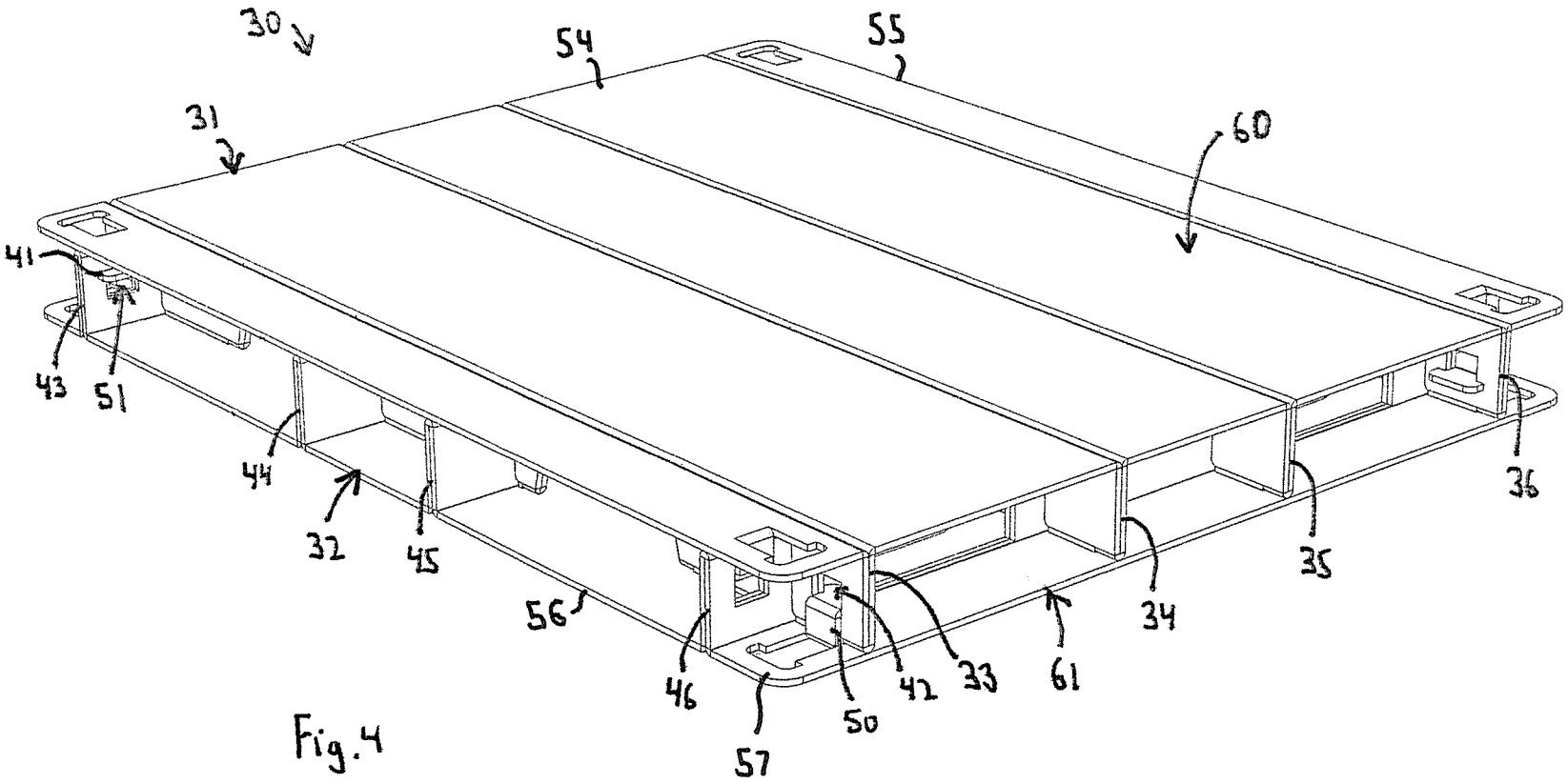
FIG. 4 is an isometric drawing of the corrugated pallet of FIG. 1 with interior strap locks engaged with support ribs in accordance with the invention.
Figure 5:
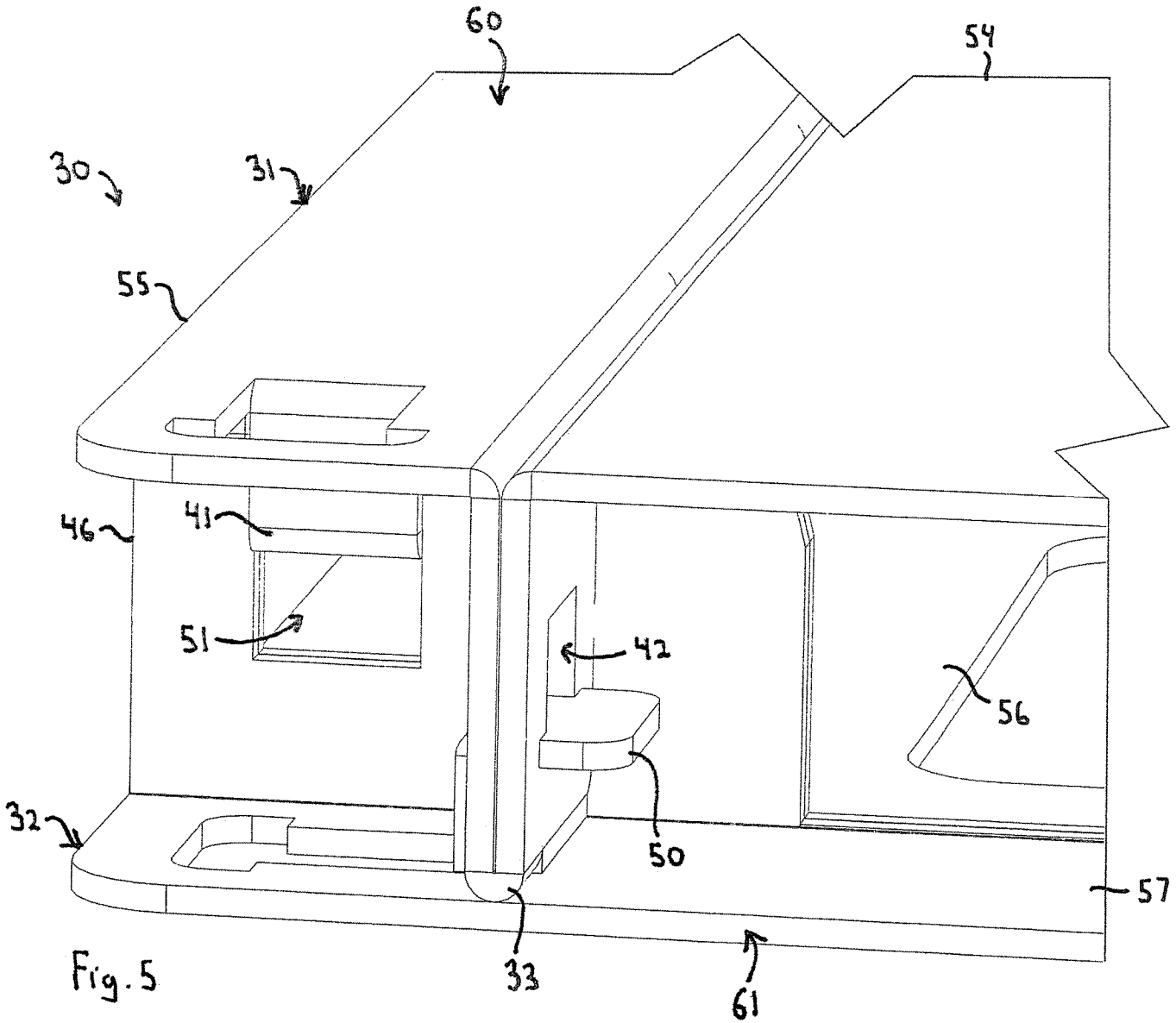
FIG. 5 is an isometric close up drawing of the corrugated pallet of FIG. 1 in accordance with the invention.

The corrugated pallet of FIG. 1 with interior strap locks engaged with support ribs in accordance with the invention is shown in isometric drawings FIGS. 4 and 5. As shown in FIGS. 4 and 5, the assembly of the pallet 30 is completed. After nesting of ribs 33, 34, 35, 35 with ribs 43, 44, 45, 46, interior strap locks 50 from bottom blank 32 at the outermost horizontal deck panel 57 are folded up into contact with interior surfaces of the rib 33 and locks directly into the opening 42 in the side of the interior support rib 33 of the top blank at a position intermediate the pallet top and bottom. Likewise interior strap locks 41 of the top blank 31 at the outermost horizontal deck panel 55 are locked into receptacle 51 of the bottom blank rib 46.

An isometric close up drawing of the corrugated pallet of FIG. 1 in accordance with the invention is shown in FIG. 5. The pallet 30 has a top deck 60 and bottom deck 61 with in between supporting ribs 33, 46. Interior strap lock 50 engages receptacle 42, and interior strap lock 41 engages receptacle 51. Although shown with rectangular receptacles and straps with locking heads, other combinations of strap designs and receptacles could also be used.

Figure 6:
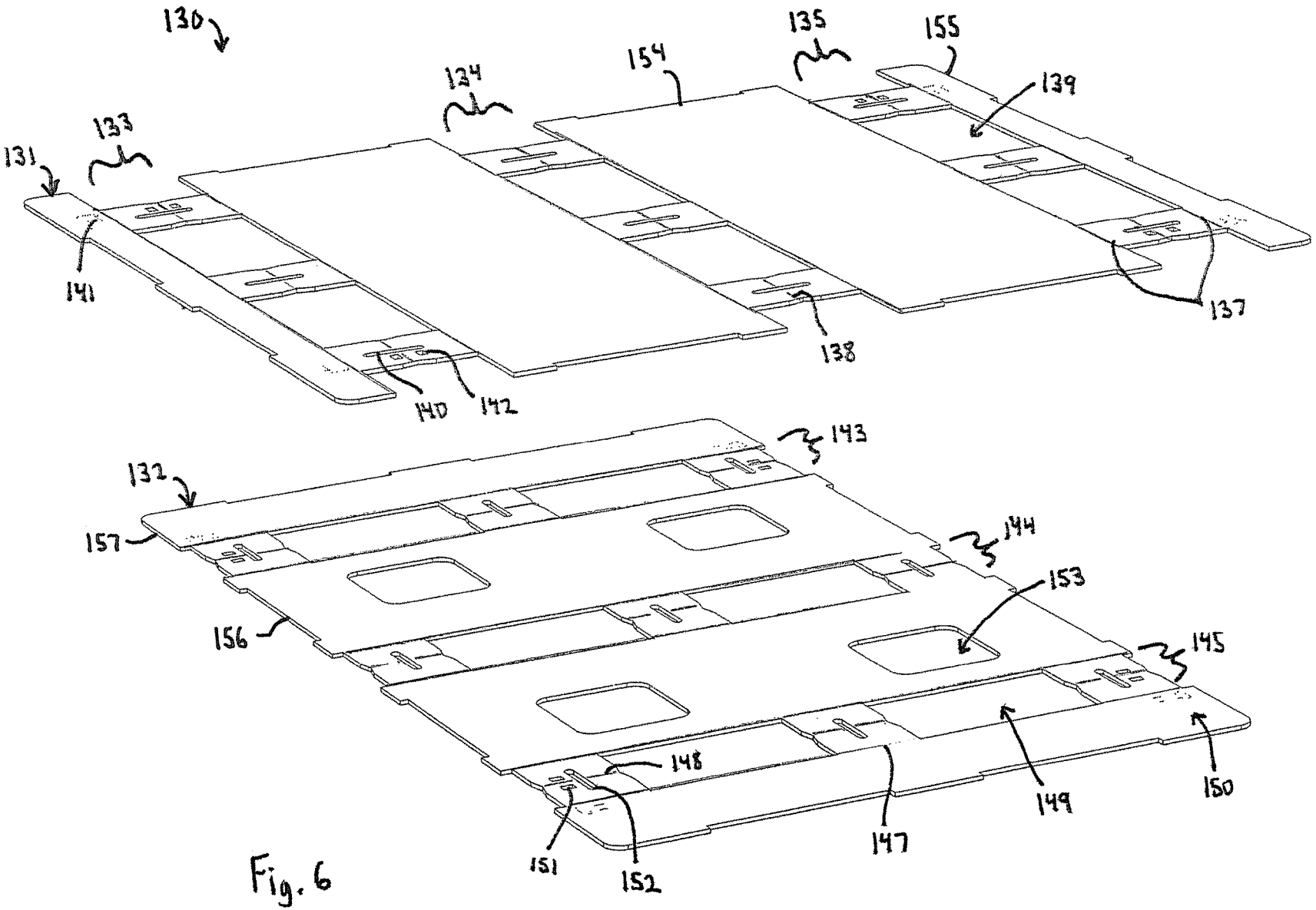
FIG. 6 is an isometric drawing of an alternate configuration corrugated pallet in unassembled state showing planar pallet top and pallet bottom blanks in the unfolded or flat configuration in accordance with the invention.
Figure 7:
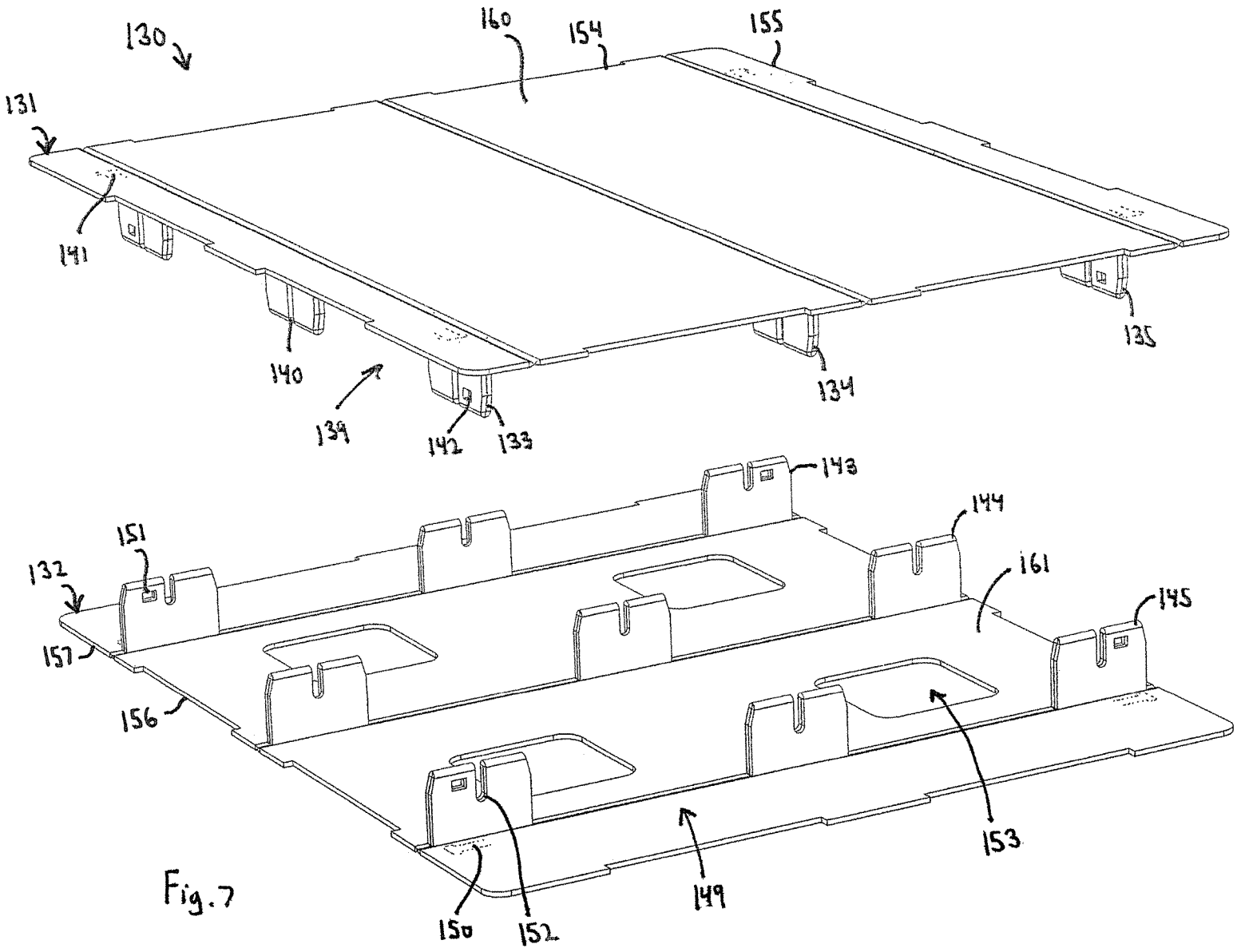
FIG. 7 is an isometric drawing of the corrugated pallet of FIG. 6 with double thickness ribs folded in accordance with the invention.

In FIGS. 6 and 7, an isometric drawing of an alternate configuration corrugated pallet in flat, unfolded and unassembled state is shown having pallet top and pallet bottom blanks 131, 132 in accordance with the invention. This version uses paper cores, shown in FIG. 8, for additional load capacity and stability. The top blank 131 has rib portions 133, 134, 135 with base fold lines 137 defining horizontal deck panels 154, 155, and crest rib fold lines 138 that form double thickness ribs when folded down from the top blank 131, as shown in FIG. 7. The ribs 133, 134, 135 also comprise notches 140 and receptacles 142. Fork passages 139 allow for lifting with a fork lift. Interior strap locks 141 are provided for locking with the bottom blank 132. The bottom blank also comprises rib sections 143, 144, 145 with base fold lines 147 defining horizontal deck panels 156, 157 and crest fold lines 148 as well as notches 152 and receptacles 151. The bottom blank further comprises fork passages 149, pallet jack wheel holes 153 and interior strap locks 150.

The isometric drawing FIG. 7 of the corrugated pallet of FIG. 6 with ribs folded in accordance with the invention is shown in FIG. 7 show more clearly the upper deck rib notches 140 that nest with the lower rib notches 152 that allow nesting of the top and bottom blanks 131 and 132 while interior strap locks 141 and receptacles 152 provide for locking with the pallet bottom 132. The pallet bottom comprises a bottom deck 161 and folded upward ribs 143, 144, 145 defining horizontal deck panels 156, 157 and notches 152 for nesting with the pallet top 131. Fork passages 139, 149 allow for lifting and moving the pallet 130. Pallet jack wheel holes 153 allow for lifting and moving with a pallet jack. Interior strap locks 141, 150 from the outermost horizontal deck panels 155, 157 lock into receptacles 151, 142, respectively, to hold the pallet top 131 and pallet bottom 132 together. Although shown in the interior corner intersections of the ribs, within the perimeter of the pallet, the locking straps 141, 150 could be placed at other locations such as the middle of the pallet inside the outer ribs 133, 135 and 143, 145.

Figure 8:
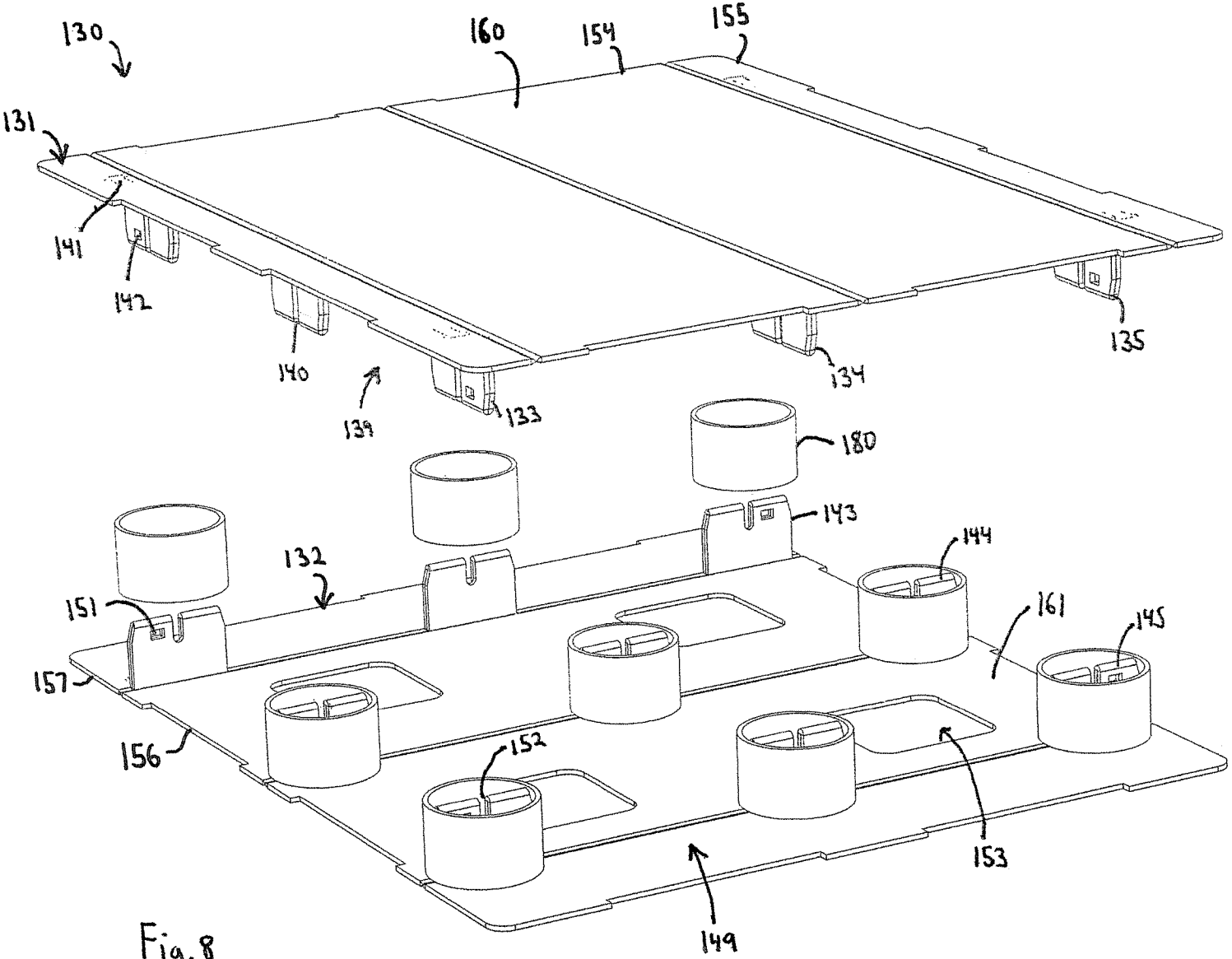
FIG. 8 is an isometric drawing of the corrugated pallet of FIG. 6 with paper cores installed in accordance with the invention.

An isometric drawing of the corrugated pallet of FIGS. 6 and 7, with paper cores 180 installed in accordance with the invention is shown in FIG. 8. The paper cores 180 are installed on the ribs 143, 144, 145 to be nested with upper ribs 133, 134, 135. Notches 140 are installed in notches 152, intersecting perpendicularly and with paper cores 180 surrounding the intersecting ribs. The paper cores 180 provide increased load support and resistance to lateral forces exerted on the pallet by lifting equipment. The reinforcement cores 180 surround intersections of folded double thickness support ribs 135, 134, and 133 with intersecting ribs 145, 144, and 143, wherein a single core distributes vertical compression against four horizontal deck panels 154, 155, 156, 157. Great benefits of strength and stability can be obtained with less cost by using cores 180 only on the corners of the ballet, while relying on the strength provided by the support ribs alone for the non-corner areas of the pallet.

Figure 9:
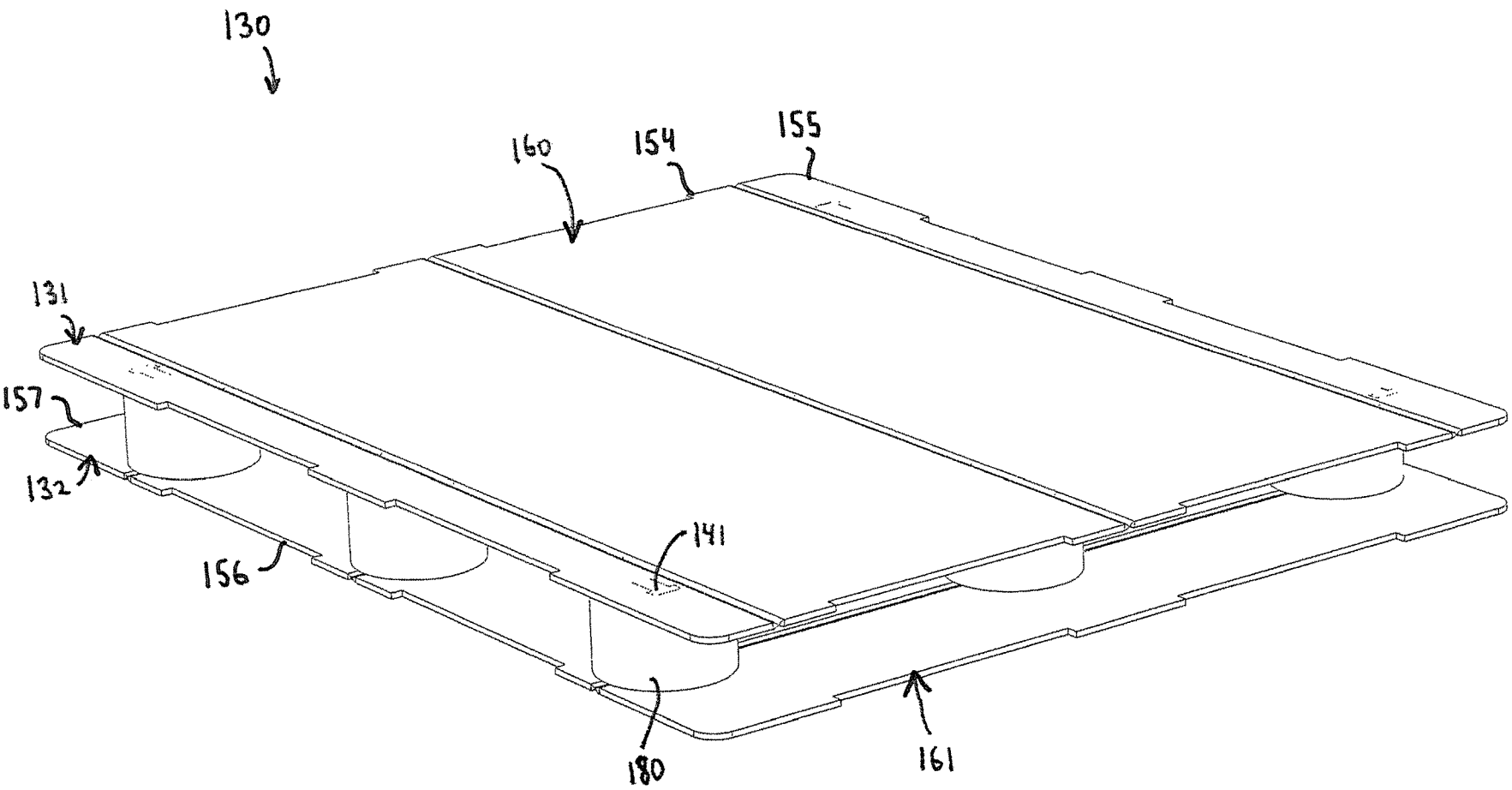
FIG. 9 is an isometric drawing of the corrugated pallet of FIG. 8 with top and bottom blanks nested in accordance with the invention.

An isometric drawing of the corrugated pallet of FIG. 6 with top and bottom blanks nested in accordance with the invention is shown in FIG. 9. The pallet top 131 is vertically assembled with pallet bottom 132, thereby trapping the paper cores 180 between upper deck 160 and lower deck 161 and the intersecting ribs 143-145 and 133-135. Although shown using nine paper cores, more or less could also be used, depending on the requirements of the application, as noted above.

Figure 10:
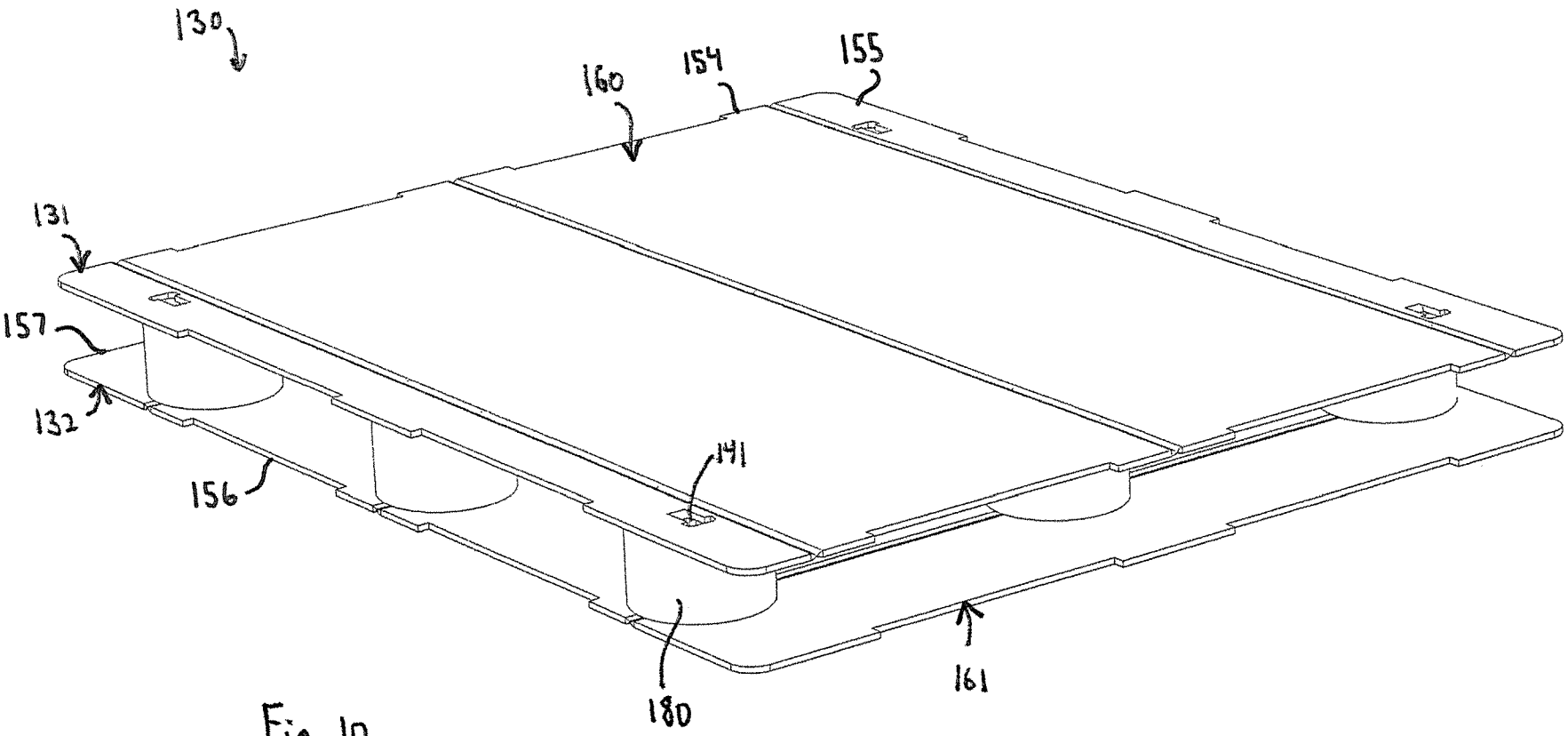
FIG. 10 is an isometric drawing of the corrugated pallet of FIG. 8 with strap locks engaged with support ribs in accordance with the invention.

An isometric drawing of the corrugated pallet of FIG. 6 with interior strap locks engaged with support ribs in accordance with the invention is shown in FIG. 10. The final step of the assembly is locking the pallet top 131 axially with the pallet bottom 132. The locking straps 141, 150 fold from outermost horizontal deck panels 155, 157 and lock into receptacles in the ribs 133, 134, 135, 143, 144, 145 inside the paper cores 180.

Figure 11:
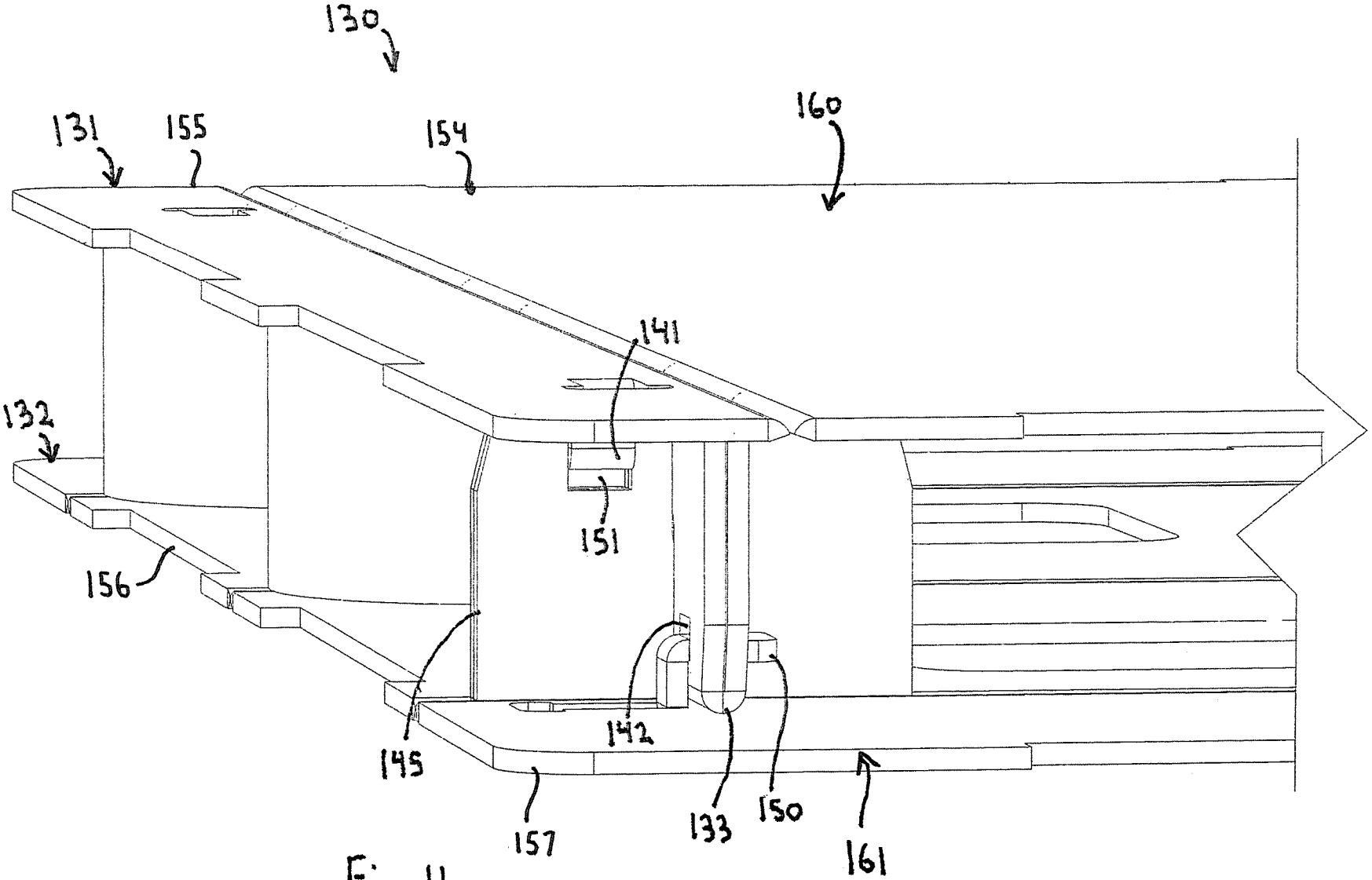
FIG. 11 is an isometric close up drawing of the (with paper cores omitted) of the corrugated pallet of FIG. 8 in accordance with the invention.

An isometric close up drawing of the intersection of ribs 133 and 145 at the center of the paper core (with paper cores omitted for clarity of illustration) of the corrugated pallet of FIG. 6 in accordance with the invention is shown in FIG. 11. Locking strap 141 from the outermost horizontal deck panel 155 of the pallet top 131 locks into receptacle 151 in lower deck rib 145. Likewise, locking strap 150 from the outermost horizontal deck panel 157 of the pallet bottom 132 locks into receptacle 142 in the upper deck rib 133. Thereby the paper cores, not shown, become locked between upper deck 160 and lower deck 161.

Figure 12:
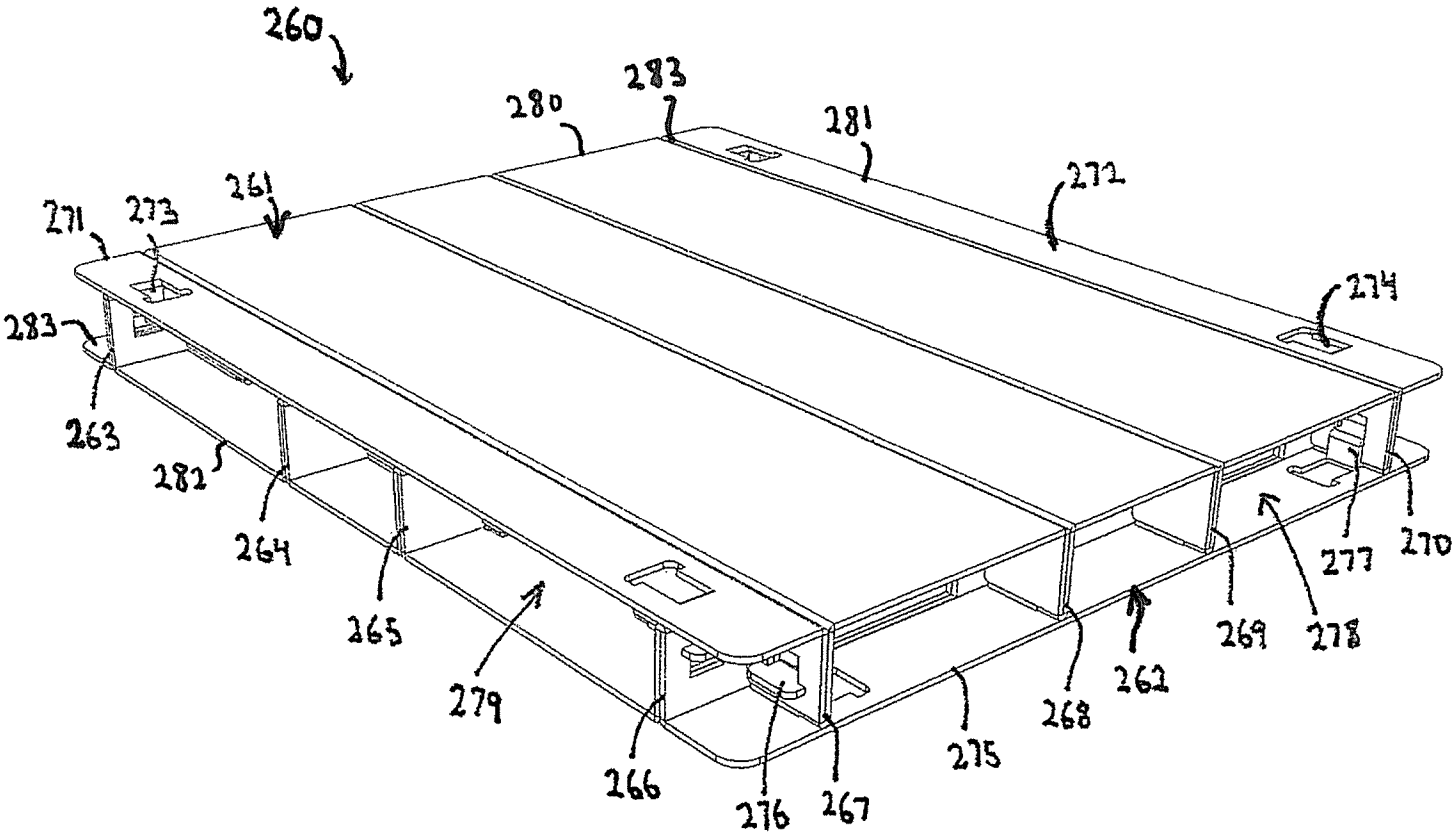
FIG. 12 is an isometric drawing of a second alternate configuration of a corrugated pallet (top view) with middle strap locks engaged in assembled state in accordance with the invention.

An isometric drawing of a second alternate configuration of a corrugated pallet (top view) in assembled state in accordance with the invention is shown is FIG. 12. In this configuration, the locking straps are inside the outer vertically folded double thickness ribs and are instead middle straps, which are actually easier to install and make a better pallet due to being closer to the middle of the pallet. The pallet 260 comprises pallet top 261 and pallet bottom 262. The pallet top 261 is comprised of folded double thickness ribs 267, 268, 269, 270 that are folded down from the pallet top 261 on fold lines 283 defining outermost horizontal deck panels 271, 272 and inner horizontal deck panels 280. The pallet bottom 262 is comprised of vertically folded double thickness ribs 263, 264, 265, 266 that are folded up from the pallet bottom 262 defining horizontal bottom inner deck panels 282 and outermost horizontal bottom deck panels 275. The pallet top 261 and pallet bottom 262 are nested together with the ribs oriented perpendicularly. Top blank middle locking straps 273, 274 lock into pallet bottom ribs 263, 266. Bottom blank middle locking straps 276, 277 lock into pallet top ribs 267, 270. Fork passages 278, 279 allow for lifting the pallet 260 from all sides. Lower blank middle locking straps 276, 277 maintain bottom outer horizontal panels 275 to be horizontal. Locking straps 273, 274 maintain top outer horizontal panels 271, 272 to be horizontal.

Figure 13:
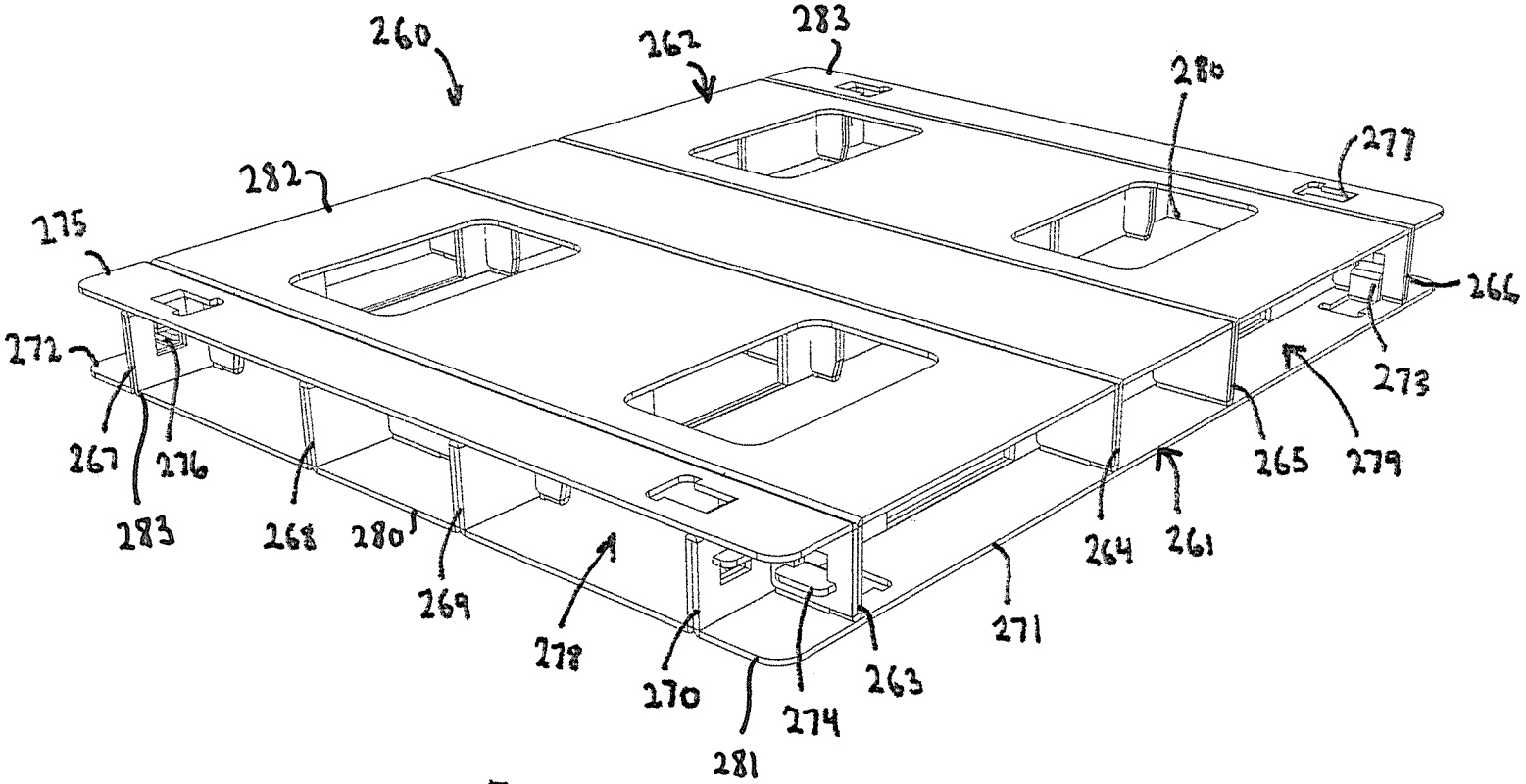
FIG. 13 is an isometric drawing of the configuration shown in FIG. 12 (bottom view) in assembled state in accordance with the invention.

An isometric drawing of the second alternate configuration of the corrugated pallet (bottom view) shown in FIG. 12 in assembled state in accordance with the invention is shown FIG. 13. The pallet 260 comprises pallet top 261 and pallet bottom 262 having vertically folded double thickness ribs 263, 264, 265, 266, 267, 268, 269, 270. Middle straps 273, 274, 276, 277 lock the pallet top 261 and pallet bottom 262 together. Fork entries 278, 279 allow for lifting of the pallet by forklift or pallet jack. Bottom wheel holes 280 allow for the wheels of a pallet jack to contact the floor while the pallet jack is inside the pallet.

Figure 14:
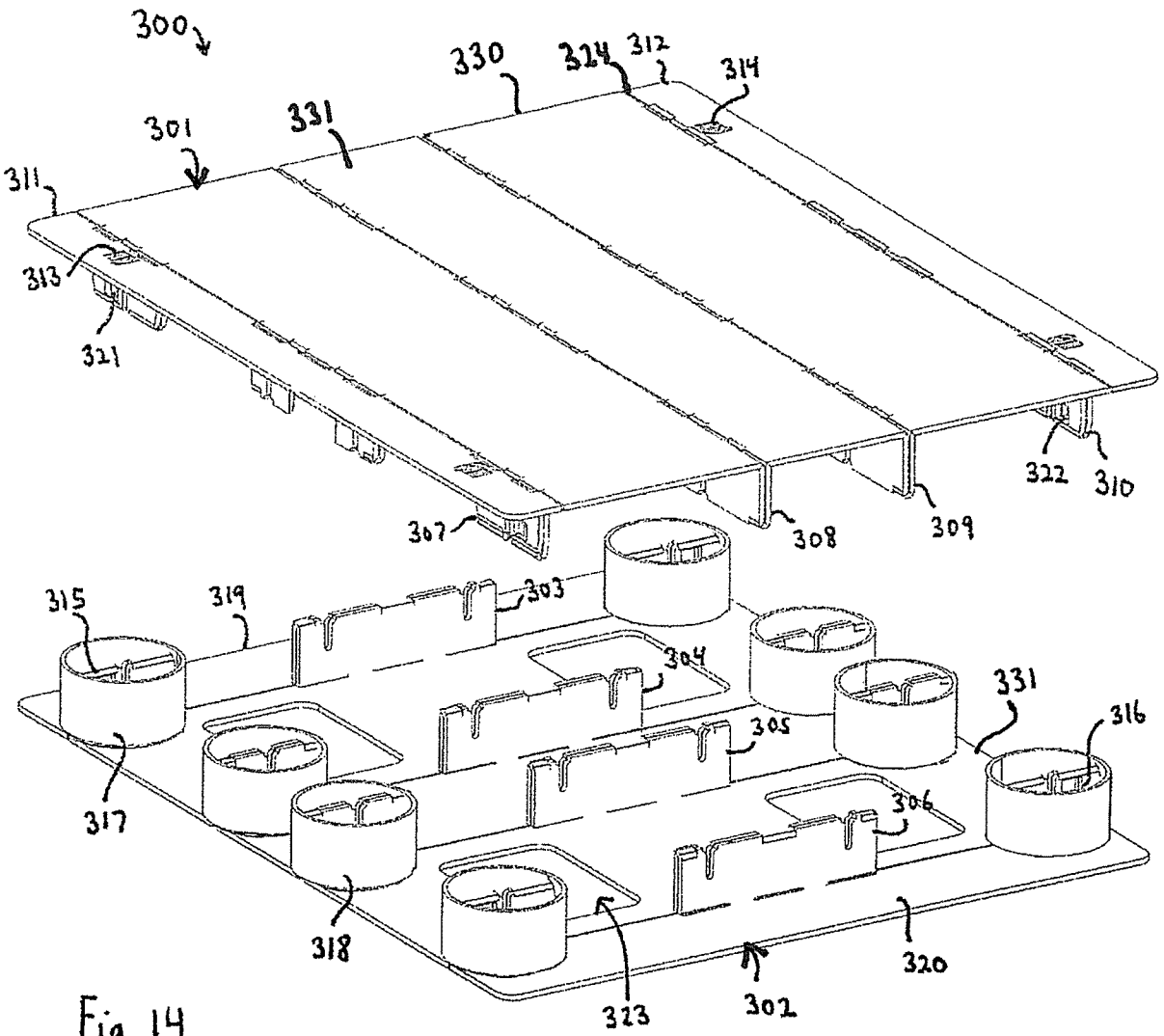
FIG. 14 is an isometric drawing of a third alternate configuration of corrugated pallet with top and bottom blanks folded in accordance with the invention.

An isometric drawing of a third alternate configuration of corrugated pallet 300 with top and bottom blanks 301, 302 folded in accordance with the invention is shown in FIG. 14. The pallet 300 comprises a pallet top 301 and a pallet bottom 302 that have integral double thickness discontinuous ribs 303-310 folded vertically on fold lines 324 defining outermost horizontal top deck panels 311, 312, and inner horizontal top deck panels 331, 330. Reinforcement cylinders 317, 318, preferably paper cores, are installed over intersections of ribs 303-310 and preferably tightly fit which provides additional vertical assembly holding force through friction. The pallet top 301 and pallet bottom 302 are secured against vertical separation, for example, by top deck strap locks 313, 314 and bottom strap locks (not shown in FIG. 14) locking through openings 315, 316, in the bottom blank ribs 303, 306 and openings 321, 322 in the top blank ribs, respectively, after the pallet top 301 and pallet bottom are vertically assembled together and at locations inside corner paper cores 317. Similar locking straps could also be provided for the inside paper cores 318. Other ways of securing the pallet top and bottom blanks against vertical separation, for example, by gluing the cylinders 317, 318 to the inside surfaces of the pallet top and bottom blanks 301, 302, could be used. Bottom openings 323 are provided for pallet jack wheels when lifting by pallet jack.

Figure 15:
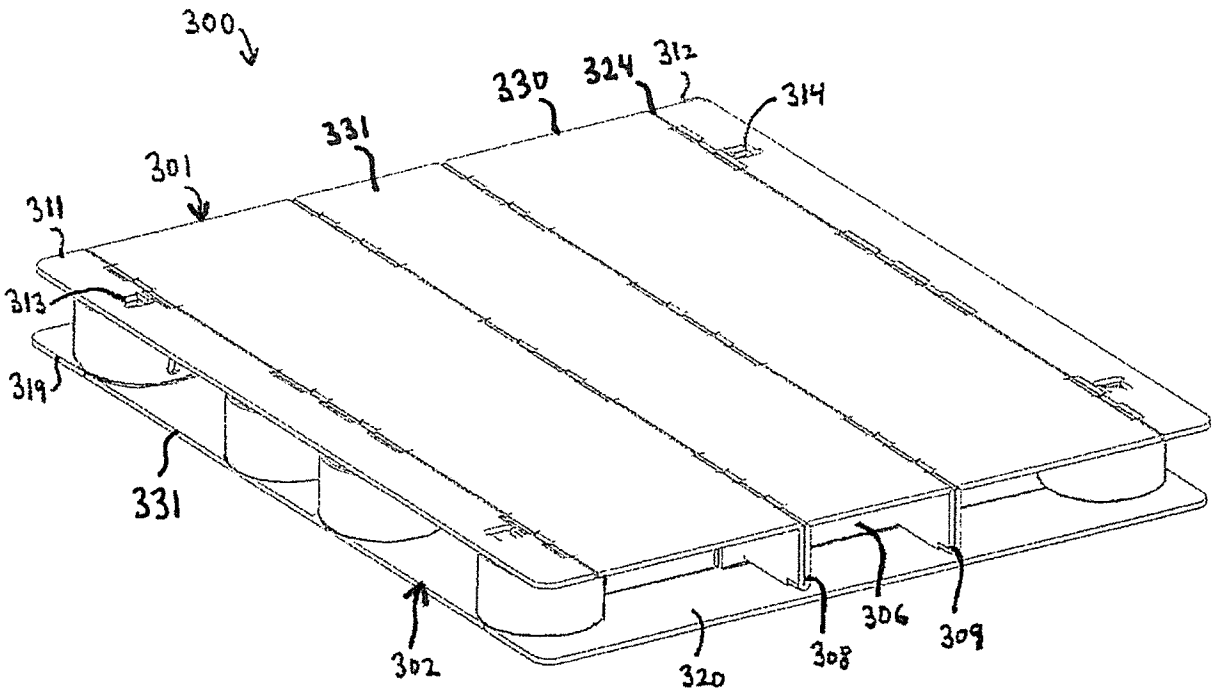
FIG. 15 an isometric drawing of the third alternate configuration shown in FIG. 14 in assembled state in accordance with the invention.

An isometric drawing of the third alternate configuration shown in FIG. 14 in assembled state in accordance with the invention is shown in FIG. 15. The pallet 300 includes pallet top 301 and pallet bottom 302 with integral vertically folded ribs 308, 309 between horizontal deck panels 311, 312, 331, 330. After assembly of the pallet top 301 and pallet bottom 302 together strap locks 313, 314 are folded down and lock through openings 321 and 322 in the folded double thickness ribs 307 and 310. Paper cores 17 located at the corners provide for both pallet stability and fork impact resistance (for example, by misaligned forks entering the fork channels) where center support is provided by longer double thickness central rib portions 303-310. The paper cores 317 provide improved stability by being located at the corners of the pallet 300, which is especially important when multiple pallets of goods are stacked. The vertically folded double thickness ribs free of reinforcement tubes provide compression support at other locations of the pallet which is much wider for greater area of top deck support than is possible if smaller paper cores were utilized with cooperating shorter length rib sections Obviously, numerous modifications and variations of the described preferred embodiments are possible and will occur to those skilled in the art in light of this disclosure.

Accordingly, we intend that these modifications and variations, and the equivalents thereof, be included within the spirit and scope of the invention as defined in the following claims, wherein we claim:

1. A corrugated pallet folded together from two opposing blanks comprising a pallet top that supports a load above a floor and a pallet bottom that rests on said floor;

each of said pallet top and said pallet bottom comprising multiple horizontal deck panels defined by rib base fold lines at base ends of multiple integral double thickness ribs folded from said blanks and extending vertically to distal rib crests at center rib crest fold lines, wherein ribs from said pallet top intersect with ribs of said pallet bottom perpendicularly and support said pallet top on said pallet bottom resisting vertical compression;

said pallet further comprising mechanical straps that resist vertical tensile separation of said pallet top with said pallet bottom to lock said pallet together, said straps being folded vertically from said horizontal deck panels and locking to said integral vertically folded double thickness ribs of the opposing blank at positions vertically intermediate between horizontal deck panels of said pallet top and said pallet bottom;

said straps from said horizontal deck panels fold perpendicularly to said rib crest fold lines of said integral vertically folded double thickness ribs of the same blank and parallel to said crest fold lines of said integral vertically folded double thickness ribs of the opposing blank.

2. A corrugated pallet as described in claim 1 wherein:

said straps of said horizontal deck panels fold vertically to lie adjacent to said integral vertically folded double thickness ribs of said opposing blank.

3. A corrugated pallet as described in claim 1 wherein:

said straps of said pallet top and said pallet bottom are folded in perpendicular directions to each other.

4. A corrugated pallet as described in claim 1 wherein:

said straps fold vertically from one blank and lock through said integral vertically folded double thickness ribs of said opposing blank whereby heads of said straps resist unfolding of said integral vertically folded double thickness ribs of said opposing blank.

5. A corrugated pallet as described in claim 1 wherein:

said pallet comprises reinforcement tubes surrounding intersections of said integral vertically folded double thickness ribs of said pallet top and said pallet bottom wherein a single said reinforcement tube distributes said vertical compression against more than two horizontal deck panels.

6. A corrugated pallet as described in claim 5 wherein:

said straps are folded from said horizontal deck panels and lock with said opposing blank by folding through said integral vertically folded double thickness ribs of the opposing blank at locations inside said reinforcement tubes.

7. A corrugated pallet as described in claim 5 wherein:

said reinforcement tubes provide compression support at locations near the corners of said pallet, and vertically folded double thickness ribs free of reinforcement tubes provide compression support at other locations of said pallet.

8. A corrugated pallet folded together from two opposing blanks comprising top and bottom blanks forming a pallet top blank that supports a load above a floor and a pallet bottom that rests on said floor;

each of said pallet top and said pallet bottom comprising multiple horizontal deck panels, including two outermost horizontal deck panels defined by rib base fold lines and outer deck edges, and at least one inner horizontal deck panel defined by two spaced apart rib base fold lines, said pallet top and bottom also each including multiple integral vertically folded double thickness ribs extending vertically from said rib base fold line to at least one center rib crest fold line, wherein ribs from said pallet top intersect with ribs of said pallet bottom perpendicularly and support said pallet top on said pallet bottom resisting vertical compression;

said pallet further comprising mechanical straps that hold said pallet top in vertically spaced relation with said pallet bottom, said straps being folded vertically from said horizontal deck panels and locking with said integral vertically folded double thickness ribs of the opposing blank at positions intermediate between said pallet top surface and said pallet bottom surface;

said straps are folded from the outermost horizontal deck panels, wherein said straps hold said outermost horizontal deck panels to resist deviation from horizontal.

9. A corrugated pallet as described in claim 8 wherein:

said straps of said outermost horizontal deck panels fold vertically to lie adjacent to said integral vertically folded double thickness ribs of said opposing blank.

10. A corrugated pallet as described in claim 8 wherein:

said straps of said pallet top and said pallet bottom are folded in perpendicular directions to each other, with straps folding from said outermost horizontal deck panels of both of said top and bottom blanks.

11. A corrugated pallet as described in claim 8 wherein:

said straps fold vertically from one blank and lock through said integral vertically folded double thickness ribs of said opposing blank whereby heads of said straps resist unfolding of said integral vertically folded double thickness ribs of said opposing blank at locations between said integral folded double thickness ribs and the edges of said opposing blank.

12. A corrugated pallet as described in claim 8 wherein:

said pallet comprises reinforcement tubes surrounding intersections of said integral vertically folded double thickness ribs of said pallet top and said pallet bottom wherein a single said reinforcement tube distributes said vertical compression against more than two horizontal deck panels including said outermost horizontal deck panels.

13. A corrugated pallet as described in claim 12 wherein:

said straps are folded from said outermost horizontal deck panels and lock with said opposing blank by folding through said integral vertically folded double thickness ribs of the opposing blank at locations inside said reinforcement tubes.

14. A corrugated pallet as described in claim 12 wherein:

said reinforcement tubes provide compression support at locations near corners of said pallet, and vertically folded double thickness ribs free of reinforcement tubes provide compression support at other locations of said pallet.

15. A corrugated pallet folded together from two opposing blanks comprising top and bottom blanks forming a pallet top blank that supports a load above a floor and a pallet bottom that rests on said floor;

each of said pallet top and said pallet bottom comprising multiple integral vertically folded double thickness ribs extending vertically from base fold lines vertically to rib crest fold lines, wherein ribs from said pallet top intersect with ribs of said pallet bottom perpendicularly and support said pallet top on said pallet bottom resisting vertical compression exerted by said load;

said pallet top and pallet bottom secured against vertical separation and each having multiple horizontal deck panels defined by rib base fold lines.

said pallet comprises reinforcement tubes surrounding intersections of said integral vertically folded double thickness ribs of said pallet top and said pallet bottom wherein a single said reinforcement tube distributes said vertical compression against at least two adjacent horizontal deck panels of said pallet top;

said reinforcement tubes provide compression support at locations near corners of said pallet, and vertically folded double thickness ribs free of reinforcement tubes provide compression support at other locations of said pallet.

16. A corrugated pallet as described in claim 15 wherein:

said pallet further comprising mechanical straps that are folded vertically from said horizontal deck panels and through said integral vertically folded double thickness ribs of the opposing blank at locations inside said reinforcement tubes.

17. A corrugated pallet as described in claim 16 wherein:

said straps of said pallet top and said pallet bottom are folded in perpendicular directions to each other with each comprising locks to integral vertically folded double thickness ribs of the opposing blanks at locations inside said reinforcement tubes.

18. A corrugated pallet as described in claim 15 wherein:

said pallet further comprising mechanical straps that are folded vertically from said horizontal deck panels and are locked with said integral vertically folded double thickness ribs of of the opposing blank wherein said mechanical straps fold vertically to lie adjacent said vertically folded double thickness ribs.

19. A corrugated pallet as described in claim 18 wherein:

said straps fold vertically from one blank and lock through said integral vertically folded double thickness ribs of said opposing blank whereby heads of said straps resist unfolding of said integral vertically folded double thickness ribs of said opposing blank.

20. A corrugated pallet as described in claim 15 wherein:

said pallet further comprising mechanical straps that are folded vertically from said the outermost horizontal deck panels located at the edges of said pallet and are locked with said integral vertically folded double thickness ribs of the opposing blank, wherein said straps hold said outermost horizontal deck panels to resist deviation from horizontal.

* * * * *